US005493227A

United States Patent [19]

Shimasaki et al.

[11] Patent Number: 5,493,227

[45] Date of Patent: Feb. 20, 1996

[54] MISFIRE-DETECTING SYSTEM FOR INTERNAL COMBUSTION ENGINES

[75] Inventors: Yuichi Shimasaki; Masaki Kanehiro; Hirokazu Ohsaki; Jiro Takagi; Katsumi Noguchi, all of Wako; Kanehisa Kitukawa, Aichi, all of Japan

[73] Assignees: Honda Giken Kogyo Kabushiki Kaisha, Tokyo; NGK Spark Plug Co., Ltd., Aichi, both of Japan

[21] Appl. No.: 360,935

[22] Filed: Dec. 21, 1994

[30] Foreign Application Priority Data

Dec. 21, 1993 [JP] Japan ..... 5-346670

[51] Int. Cl.[6] ..... F02P 17/00

[52] U.S. Cl. ..... 324/378; 73/117.3; 324/388

[58] Field of Search ..... 324/378, 379, 324/388, 391; 73/117.3, 35.08, 116; 123/644

[56] References Cited

U.S. PATENT DOCUMENTS

| | | | |
|---|---|---|---|
| 4,987,771 | 1/1991 | Iwata | 73/117.3 |
| 5,212,947 | 5/1993 | Fujimoto et al. | 60/276 |
| 5,215,067 | 6/1993 | Shimasaki et al. | 324/388 X |
| 5,221,904 | 6/1993 | Shimasaki et al. | 324/378 |
| 5,327,090 | 7/1994 | Shimasaki et al. | 324/378 |
| 5,347,855 | 9/1994 | Miyata et al. | 73/116 |
| 5,347,856 | 9/1994 | Miyata et al. | 73/116 |
| 5,349,299 | 9/1994 | Kanehiro et al. | 324/391 X |
| 5,431,044 | 7/1995 | Kiess et al. | 73/117.3 |

FOREIGN PATENT DOCUMENTS 5164033 6/1993 Japan .

*Primary Examiner*—Kenneth A. Wieder
*Assistant Examiner*—Glenn W. Brown
*Attorney, Agent, or Firm*—Nikaido, Marmelstein, Murray & Oram

[57] ABSTRACT

A misfire-detecting system for an internal combustion engine detects occurrence of a misfire in the engine, based on voltage between both ends of a spark plug assumed when sparking discharge takes place at the spark plug. A diode is arranged in an ignition secondary circuit of the engine, for checking reverse current flowing in the circuit in a direction reverse to the direction of flow of current occurring when spark ignition takes place at the spark plug. An ECU detects reverse current flowing in the ignition secondary circuit, and detects an abnormality of the diode, based on the detected reverse current.

7 Claims, 10 Drawing Sheets

V1
0V
t0
V0
Tth

V2
Vth
0V

V1
V0
0V
t0
Tth
tB

V2
Vth
0V

A
t0
B'
V1
VCOMP
C'

C
B
t0
t2 t3
t5

D'
D
t1 t2
t4
t5
VT
E'
VTREF

E
t0
t1 t2
t4
t6 t0
t6

MISFIRE-DETECTING SYSTEM FOR INTERNAL COMBUSTION ENGINES

BACKGROUND OF THE INVENTION

1. Field of the Invention

This invention relates to a misfire-detecting system for internal combustion engines, and more particularly to a misfire-detecting system of this kind which has a function of detecting an abnormality thereof.

2. Prior Art

FIG. 1 shows the arrangement of an ignition circuit and a sparking voltage-detecting circuit incorporated in a misfire-detecting system proposed, for example, by U.S. Pat. No. 5,212,947. In the figure, illustration of a distributor is omitted.

As shown in the figure, a terminal T2 is connected to a base of a transistor 4 which has its emitter grounded. The terminal T2 is supplied with an ignition command signal from an electronic control unit (hereinafter referred to as "the ECU"), referred to hereinafter. An ignition coil 1 is comprised of a primary coil 2 and a secondary coil 3 which have ends thereof connected to a terminal T1 which is supplied with supply voltage VB. The other end of the primary coil 2 is connected to a collector of the transistor 4, while the other end of the secondary coil 3 is connected to a anode of a diode (reverse current-checking means) 5. Further, the cathode of the diode 5 is connected to a positive electrode of a spark plug 6, a negative electrode of which is grounded.

A sparking voltage sensor 7 is provided at an intermediate portion of a connecting line 13 which connects between the diode 5 and the spark plug 6. The sensor 7 is electrostatically coupled to the connecting line 13, and forms together therewith a capacitance of several pF's. An output terminal of the voltage sensor 7 is connected via a connecting line 14 to a non-inverting input terminal of an operational amplifier 12. Connected in parallel between the line 14 and the ground are a capacitor 8, a resistance 9 and a diode 10, and the diode 10 has its anode grounded. A diode 11 is connected between the connecting line 14 and a supply voltage-feeding line VBS (which is supplied with stabilized supply voltage) with its cathode being connected to the supply voltage-feeding line VBS. An output terminal of the operational amplifier 12 is connected to an inverting input terminal thereof and a terminal T3. Symbol $C_0$ indicates a floating capacitance present in the vicinity of plug electrodes.

According to the sparking voltage-detecting circuit constructed as above, voltage between the spark plug electrodes is divided by the capacitance of the voltage sensor 7 and the capacitance of the capacitor 8, and then input to the operational amplifier 12. The operational amplifier 12 acts as an impedance converter, which outputs the input voltage as it is. The diodes 10 and 11 act to control the input voltage to the operational amplifier 12 to a range of 0 to the supply voltage VBS.

When an ignition command signal is input to the terminal T2, discharge current flows through the diode 5 and then between the electrodes of the spark plug 6, whereas current (reverse current) flowing from the spark plug 6 to the secondary coil 3 is checked by the diode 5. Consequently, the sparking voltage detected upon misfiring is maintained at a high value for a prolonged time period (as indicated by the broken line B' of FIG. 8B), whereby occurrence of a misfire can be detected with accuracy.

However, when the diode 5 as the reverse current-checking means becomes faulty (short circuit), reverse current is not checked by the diode, and hence electric charge stored in the floating capacitance $C_0$ in the vicinity of the sparking plug electrodes is discharged as the voltage on the side of the secondary coil 3 lowers, so that the sparking voltage quickly decreases even when a misfire occurs, resulting in degraded accuracy of misfire detection.

Besides, even when the diode 5 functions normally, if the spark plug 6 is in a so-called smoldering state, i.e. a state where fuel adheres to the plug electrodes such that no spark ignition takes place, the insulation resistance between the electrodes of the spark plug lowers, so that discharge takes place between the electrodes of the spark plug even upon misfiring, similarly to normal combustion. Therefore, it has been difficult to discriminate a failure of the diode 5 from smoldering of the spark plug, etc. by monitoring the waveform of the sparking voltage, according to the conventional system.

Smoldering of the spark plug is a temporary phenomenon, which spontaneously disappears with the lapse of time, i.e. with operation of the engine. However, a failure of the diode 5 does not automatically heal in most cases, and therefore it is necessary to determine that the misfire-detecting system suffers from a failure when the diode 5 is faulty, and warn the driver or an occupant of the failure to take an appropriate failsafe action. That is, it is necessary to discriminate a failure of the diode 5 from smoldering of the spark plug, etc.

SUMMARY OF THE INVENTION

It is the object of the invention to provide a misfire-detecting system for internal combustion engines, which is capable of accurately detecting a failure of reverse current-checking means which is arranged on the secondary coil side of an ignition circuit of the engine.

To attain the above object, the present invention provides a misfire-detecting system for an internal combustion engine having at least one spark plug, each having opposite ends, and an ignition secondary circuit connected to each of the at least one spark plug, comprising:

reverse current-checking means provided in the ignition secondary circuit, for checking reverse current flowing in the ignition secondary circuit in a direction reverse to a direction of flow of current occurring when spark ignition takes place at the each of the at least one spark plug;

misfire-detecting means for detecting occurrence of a misfire in the engine, based on voltage between the opposite ends of the each of the at least one spark plug assumed when spark discharge takes place at the each of the at least one spark plug;

reverse current-detecting means for detecting the reverse current in the ignition secondary circuit; and abnormality-detecting means for detecting an abnormality of the reverse current-checking means, based on the reverse current detected by the reverse current-detecting means.

Preferably, the abnormality-detecting means carries out detection of the abnormality of the reverse current-checking means when the engine is in a non-combustion state.

More preferably, the misfire-detecting system includes abnormality detection-inhibiting means for inhibiting the abnormality-detecting means from carrying out detection of the abnormality of the reverse current-checking means when a misfire occurs in the engine.

Also preferably, the abnormality-detecting means compares a value of the reverse current detected by the reverse current-detecting means with a predetermined value, and determines that the reverse current-checking means is in an abnormal state when the value of the detected reverse current exceeds the predetermined value.

More preferably, the predetermined value is set based on at least one operating parameter of the engine including a load on the engine.

Advantageously, the abnormality-detecting means carries out detection of the abnormality of the reverse current-checking means within a predetermined time period from the time of generation of an ignition command signal.

Alternatively, the abnormality-detecting means determines that the reverse current-checking means is in the abnormal state when the value of the detected reverse current continuously exceeds the predetermined value over a predetermined time period.

The above and other objects, features and advantages of the invention will become more apparent from the following detailed description taken in conjunction with the accompanying drawings.

BRIEF DESCRIPTION OF THE DRAWINGS

FIG. 8 collectively forms a timing chart which is useful in explaining the operation of the FIG. 7 circuit, in which:

DETAILED DESCRIPTION

The invention will now be described in detail with reference to the drawings showing an embodiment thereof.

Figure 1:
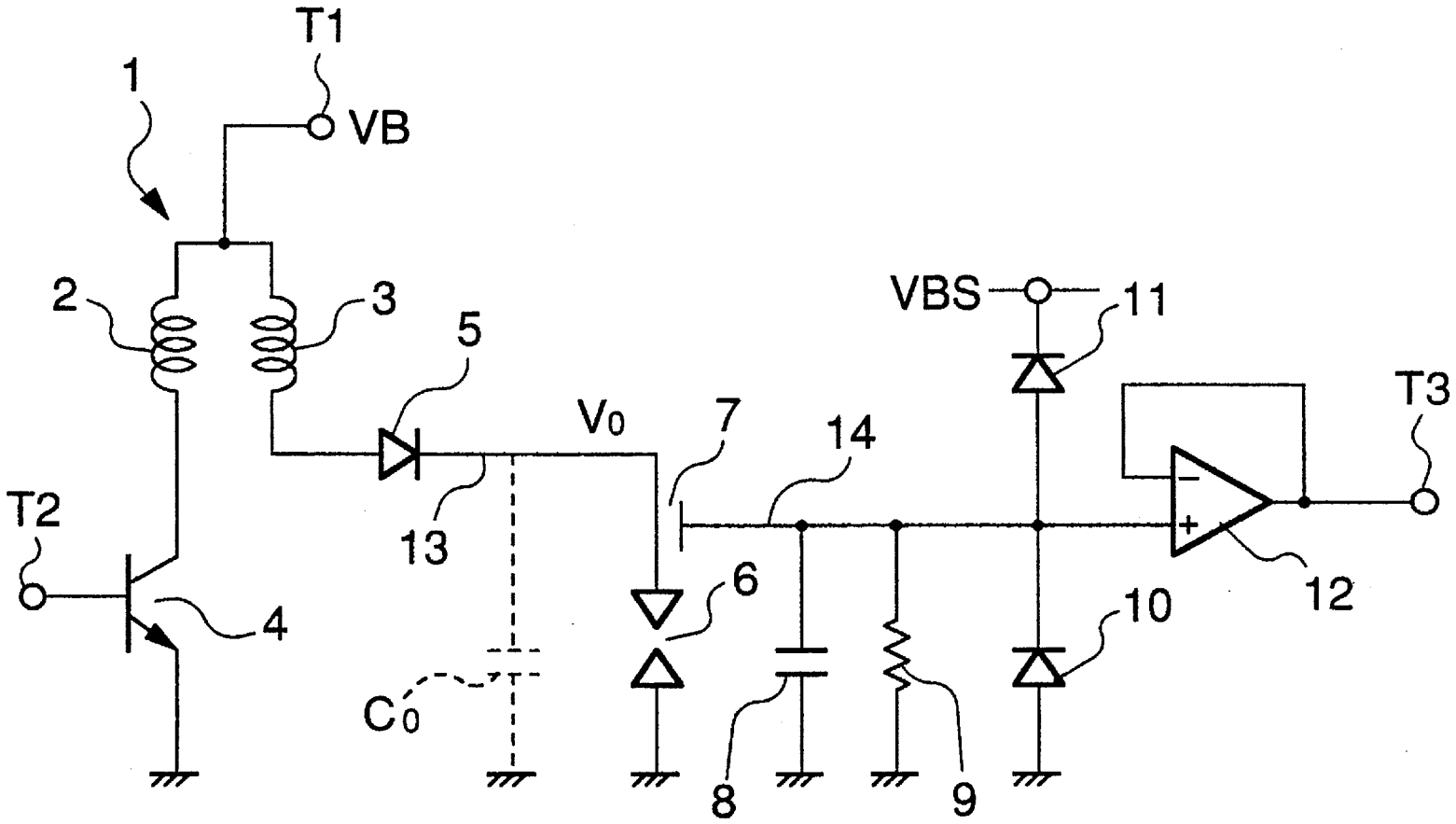
FIG.1 PRIOR ART
FIG. 1 is a circuit diagram showing an arrangement of an ignition circuit and a sparking voltage-detecting circuit of an internal combustion engine, according to a conventional misfire-detecting system.
Figure 2:
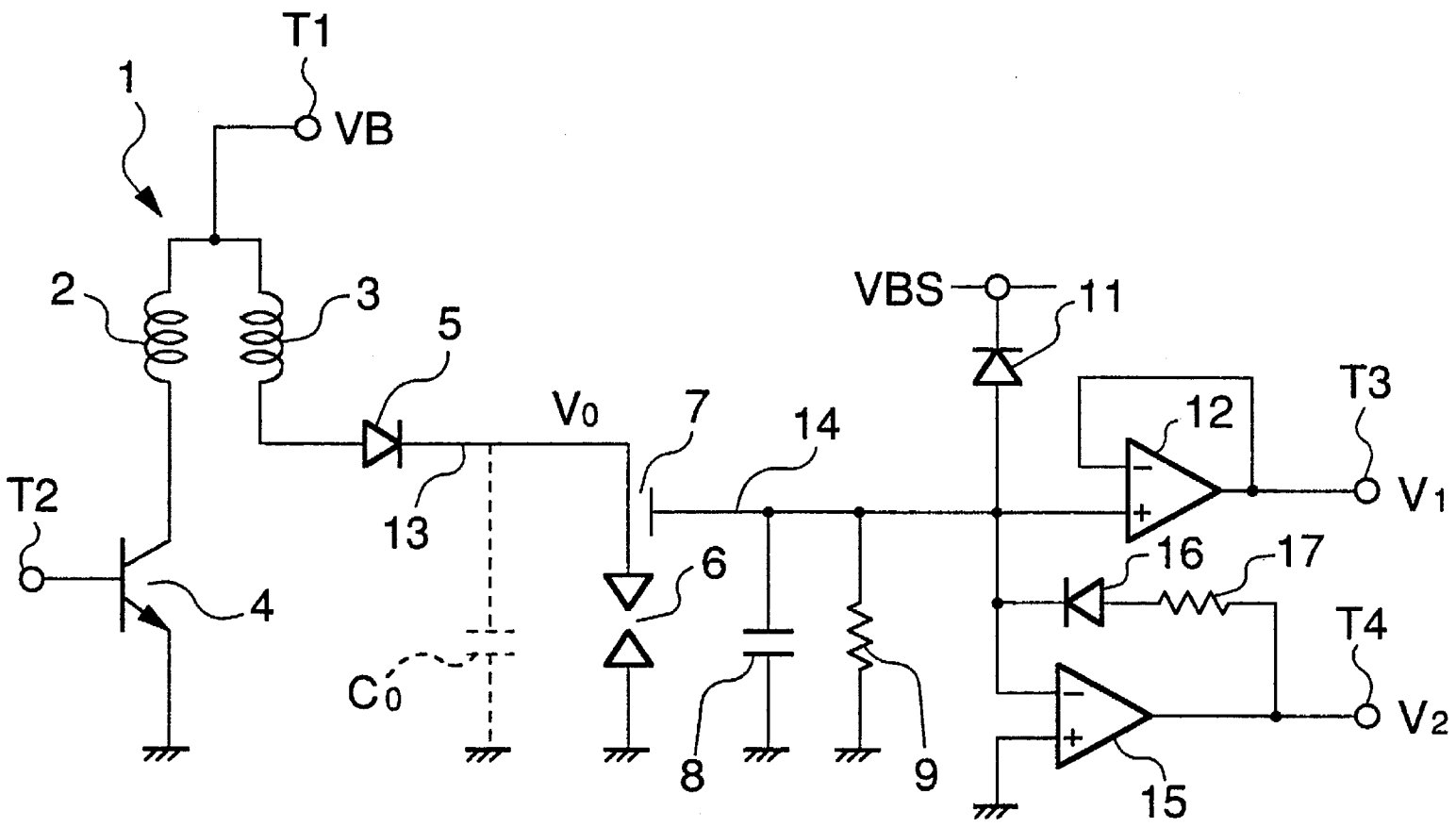
FIG. 2 is a circuit diagram showing an arrangement of an ignition circuit and a sparking voltage-detecting circuit of an internal combustion engine, according to an embodiment of the invention.

Referring first to FIG. 2, there is illustrated the arrangement of an ignition circuit and a sparking voltage-detecting circuit of an internal combustion engine, according to an embodiment of the invention, wherein elements and parts corresponding to those in FIG. 1 are designated by identical numerals, and description of which is omitted.

In FIG. 2, the diode 10 of FIG. 1 is replaced by an operational amplifier 15, a diode 16 and a resistance 17, as compared with the FIG. 1 circuit. The other elements and construction are identical with those in FIG. 1. A non-inverting input terminal of the operational amplifier 15 is grounded, while an inverting input terminal thereof is connected to the connecting line 14. An output terminal of the operational amplifier 15 is connected via the resistance 17 and the diode 16 to the inverting input terminal of the operational amplifier 15 as well as to a terminal T4. The diode 16 has a cathode thereof connected to the inverting input terminal of the operational amplifier 15.

Figure 3A:
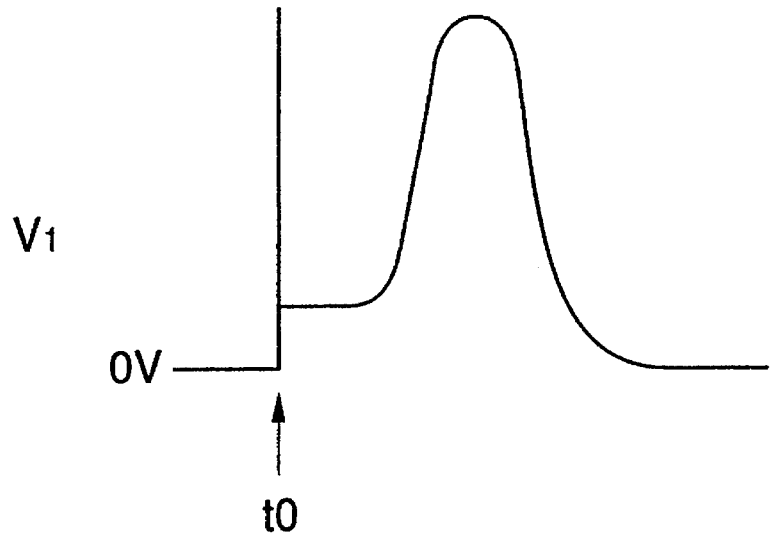
FIG. 3 shows waveforms of output voltages $V_1$ and $V_2$ from the circuit appearing in FIG. 2, which are obtained when a spark plug of the engine is smoldering.
Figure 3B:
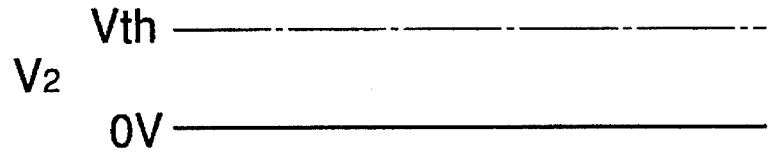
Figure 6A:
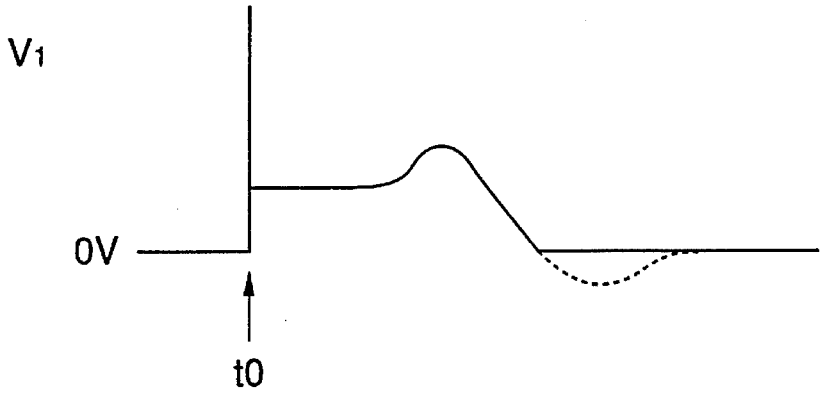
FIG. 6 shows waveforms of output voltages $V_1$ and $V_2$ from the circuit appearing in FIG. 2, which are obtained when the misfire-detecting system is in a normal state.
Figure 6B:
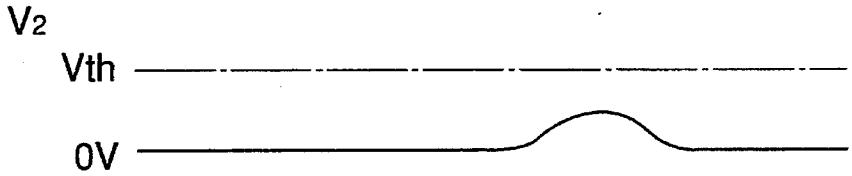

With the arrangement of FIG. 2, if the spark plug 6 is in a smoldering state, and at the same time the diode 5 functions normally, voltage $V_1$ at the terminal T3 shows a waveform shown in FIG. 3(*a*), which is similar to a waveform at normal combustion (see FIG. 6), which relatively promptly declines. However, the discharge duration thereof is longer than that at normal combustion. On this occasion, since the diode 5 functions normally, reverse current does not flow from the spark plug 6 to the secondary coil 3. Accordingly, a potential at the connecting line 14 does not lower below 0 volts, and hence no current flows through the resistance 17, whereby voltage $V_2$ at the terminal T4 is maintained at 0 volts (see FIG. 3(*b*). In FIG. 3, the time point t0 indicates the time the ignition command signal is generated.

Figures 4A, 4B:
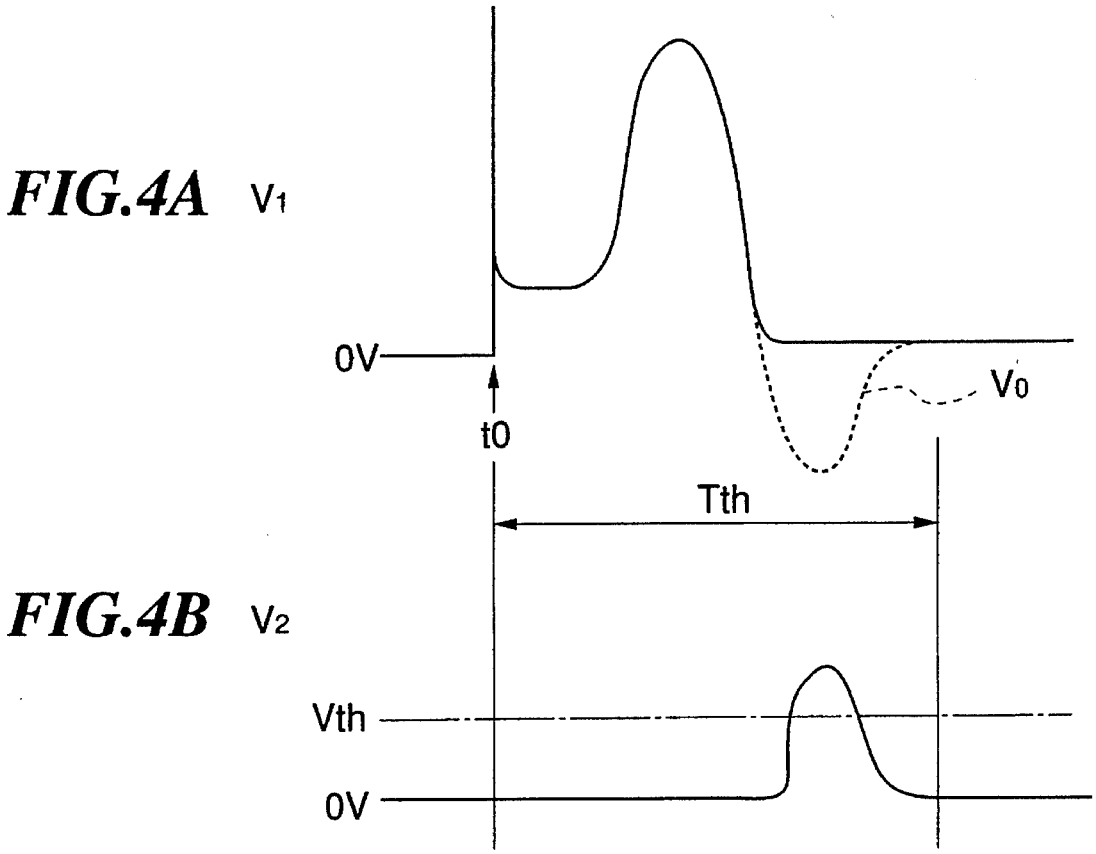
FIG. 4 shows waveforms of output voltages $V_1$ and $V_2$ from the circuit appearing in FIG. 2, which are obtained when reverse current-checking means is faulty.

On the other hand, if a misfire has occurred with the diode 5 being faulty, i.e. in a state where the diode 5 fails to check reverse current, the voltage $V_1$ varies, as shown in FIG. 4(*a*), almost similarly to the voltage $V_1$ in FIG. 3(*a*). On this occasion, as indicated by the broken line, voltage $V_0$ between the electrodes of the spark plug 6 sways below 0 volts at termination of discharge. This is because a resonance takes place due to the self-inductance of the secondary coil 3 and the floating capacitance $C_0$ after lowering of the voltage on the secondary coil 3 side, whereby reverse current flows to the secondary coil 3. On this occasion, the voltage on the connecting line 14 is about to lower below 0 volts, however, it is maintained at approximately 0 volts due to conduction of the diode 16, whereby the voltage $V_1$ at the terminal T3 shows a variation similar to that shown in FIG. 3(*a*). On the other hand, the voltage $V_2$ at the terminal T4 varies as shown in FIG. 4(*b*), in a manner proportional to the value of current flowing through the resistance 17. The present invention is based upon this fact. In the present embodiment, when the voltage $V_2$ exceeds a predetermined voltage level Vth, it is determined that the diode 5 is faulty. Thus, a failure of the diode 5 can be discriminated from smoldering of the spark plug without affecting the waveform of the misfire-detecting voltage $V_1$.

Figures 5A, 5B:
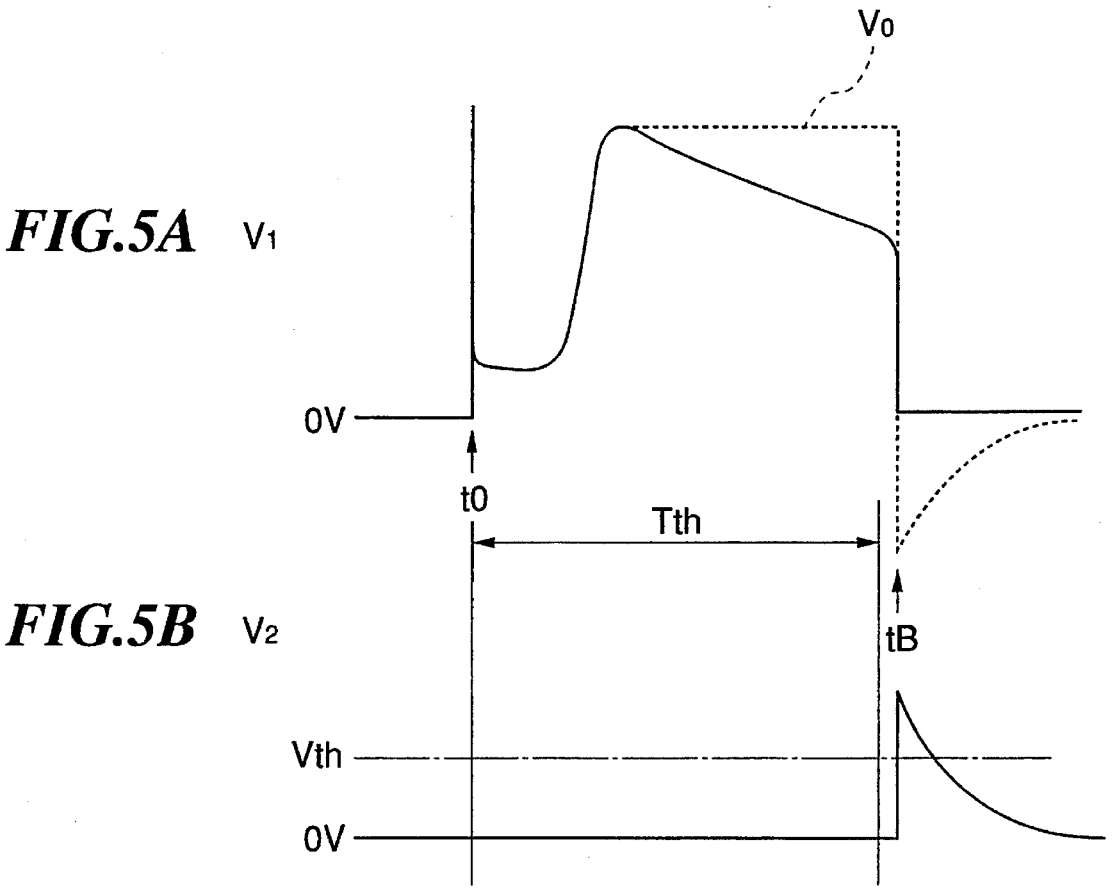
FIG. 5 shows waveforms of output voltages $V_1$ and $V_2$ from the circuit appearing in FIG. 2, which are obtained when the reverse current-checking means is normal but a fuel supply system of the engine undergoes a failure other than smoldering.

When a misfire has occurred due to a trouble in the fuel supply system other than smoldering of the spark plug, even if the diode 5 is in a normal state, discharge takes place at a time point tB when pressure within the cylinder lowers, due to dielectric breakdown between the electrodes of the spark plug, as shown in FIG. 5(*a*), whereby the voltage $v_0$ between the electrodes falls below 0 volts, as indicated by the broken line.

On this occasion, the voltage $V_2$ at the terminal T4 sometimes exceeds the predetermined voltage level Vth at the time point tB (see FIG. 5(*b*)). Therefore, it is desirable to determine that the diode 5 is faulty only when $V_2$>Vth stands within a predetermined time period Tth from the time point t0. This is because the reverse current attributable to dielectric breakdown is generated later than one attributable to a failure of the diode 5 (see FIGS. 4 and 5).

A misfiring state such as shown in FIG. 5 only sporadically occurs, and therefore it may be determined that the diode 5 is faulty only when $V_2$>Vth continuously stands over a predetermined time period, irrespective of the time period Tth.

Further, even when the diode 5 is faulty, if the engine is in a normal combustion state, the amount of reverse current flowing through the diode is so small that the voltage V2 does not exceed the predetermined level, as shown in FIG. 5. Therefore, it is desirable to carry out determination as to failure of the diode 5 during fuel cut, i.e. when fuel supply to the engine is interrupted, as a non-combustion state of the engine. It is possible to carry out detection of failure of the diode 5 even during normal combustion state of the engine, by setting the predetermined voltage level Vth to a lower value. However, improved accuracy of determination of the diode failure can be obtained when the determination is carried out during non-combustion state of the engine.

Then, the construction of a circuit for carrying out the abnormality determination and details of the manner of abnormality determination will be described with reference to FIGS. 7 to 10.

Figure 7:
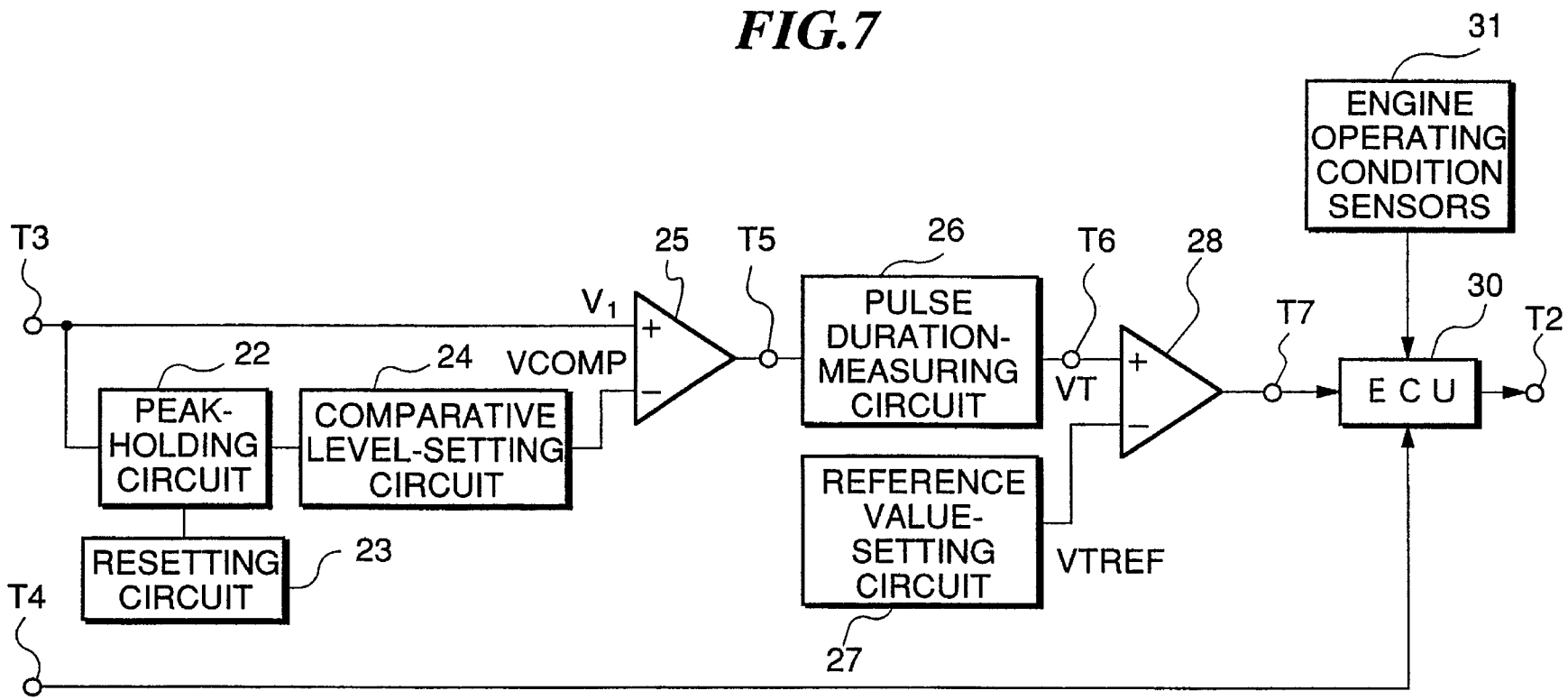
FIG. 7 is a circuit diagram showing the arrangement of a circuit for executing misfire determination and abnormality determination.

FIG. 7 shows the arrangement of the circuit which carries out misfire determination as well as the abnormality determination. The circuit is connected to the terminals T3 and T4 of FIG. 2.

In FIG. 7, the terminal T3 is connected to a peak-holding circuit 22 and a non-inverting input terminal of a first comparator 25. An output terminal of the peak-holding circuit 22 is connected via a comparative level-setting circuit 24 to an inverting input terminal of the first comparator 25. Connected to the peak-holding circuit 22 is a resetting circuit 23 which resets a held peak value at suitable timing.

An output from the first comparator 25 is input to a pulse duration-measuring circuit 26 which measures a pulse duration over which an output from the first comparator 25 is at a high level, and delivers a voltage VT corresponding to the measured pulse duration to a non-inverting input terminal of a second comparator 28. Connected to an inverting input terminal of the second comparator 28 is a reference value-setting circuit 27 which is supplied with a reference voltage VTREF for determining occurrence of a misfire. An output terminal of the second comparator 28 is connected via a terminal T7 to an ECU 30. When VT>VTREF stands, an output from the second comparator 28 is at a high level, whereby it is determined that a misfire has occurred due to a trouble in the fuel supply system. The reference voltage VTREF is set according to operating conditions of the engine.

Connected to the ECU 30 are engine operating condition sensors 31 for detecting engine operating parameters such as engine rotational speed NE, intake pipe absolute pressure PBA, engine coolant temperature TW, and intake air temperature TA. The ECU 30 is comprised of a central processing unit (CPU), a memory, an input circuit, an output circuit, etc., and not only carries out abnormality detection, described hereinafter, but also controls a fuel supply amount as well as ignition timing of the engine according to the detected operating conditions of the engine.

The operation of the circuit of FIG. 7 will be described with reference to a timing chart shown in FIG. 8. In the figure, the solid lines indicate characteristics obtained during normal combustion, while the broken lines indicate characteristics obtained upon occurrence of a misfire attributable to the fuel supply system.

Figures 8A, 8B, 8C, 8D, 8E:
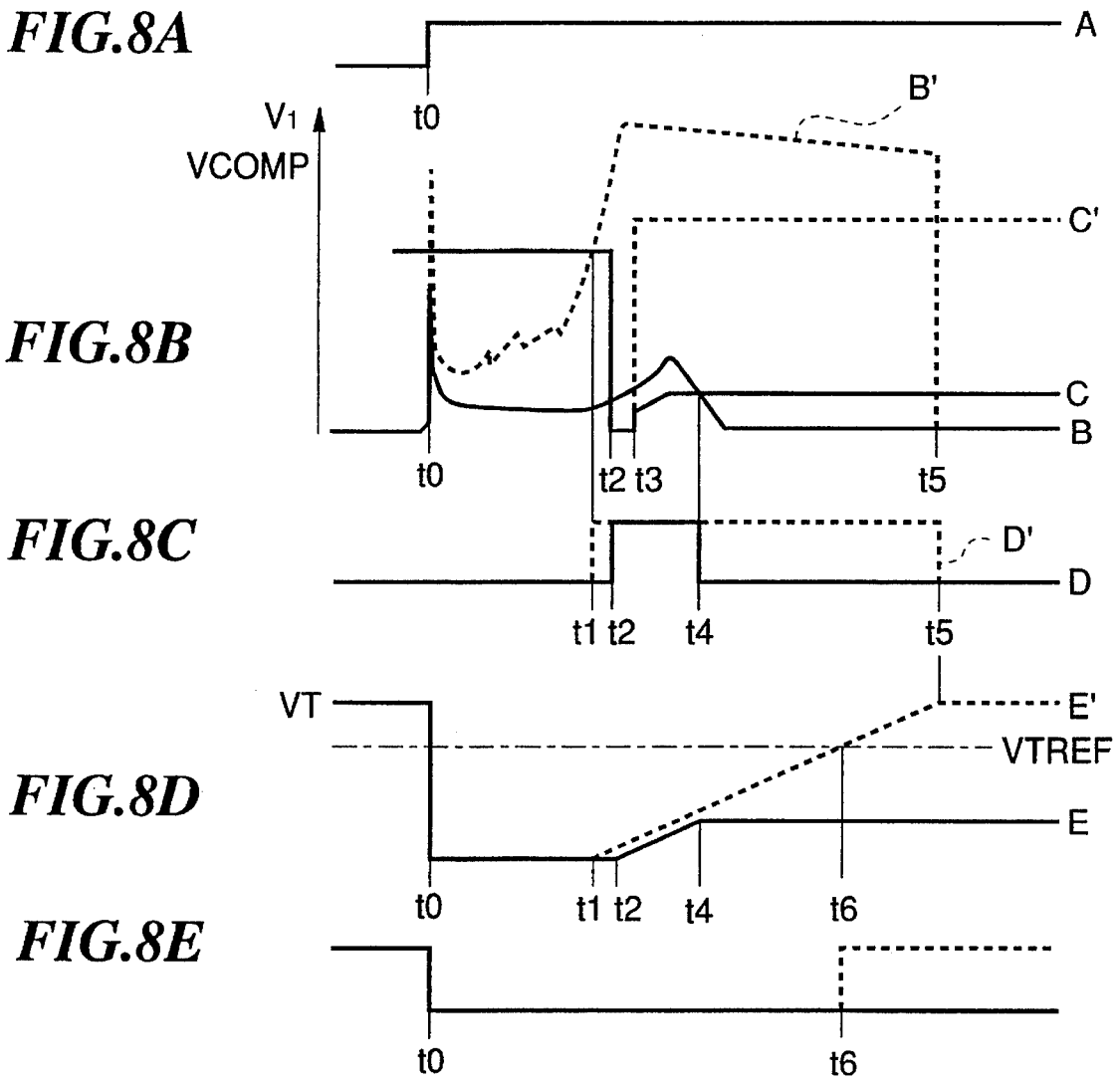
FIG. 8A shows a change in an ignition command signal A.
FIG. 8B shows changes in sparking voltage $V_1$ and a comparative voltage level VCOMP.
FIG. 8C shows changes in an output from a first comparator.
FIG. 8D shows changes in an output voltage from a pulse duration-measuring circuit.
FIG. 8E shows changes in an output from a second comparator, for determining occurrence of a misfire.

FIG. 8A shows an ignition energizing signal (ignition command signal) A.

FIG. 8B shows changes in the detected sparking voltage $V_1$ (B and B') and a comparative voltage level VCOMP (C and C').

Electric energy generated by the ignition coil 1 is supplied to the spark plug 6 via the diode 5 to be discharged between the electrodes of the spark plug 6. Residual charge left after the discharge is stored in the floating capacitance $C_0$ between the diode 5 and the spark plug 6. At normal combustion, the stored charge is neutralized by ions present in the vicinity of the electrodes of the spark plug 6 so that the sparking voltage $V_1$ promptly declines after the termination of the capacitive discharge, similarly to the case where the diode 5 is not provided (see B in FIG. 8B).

On the other hand, when a misfire occurs, almost no ion is present in the vicinity of the electrodes of the spark plug 6 so that the charge stored in the floating capacitance $C_0$ is not neutralized by ions, nor is it allowed to flow backward to the ignition coil 1 due to the presence of the diode 5. Therefore, the charge is held as it is. Then, when the pressure within the engine cylinder lowers so that the voltage between the electrodes of the spark plug 6 required for discharge to occur becomes equal to the voltage applied by the charge, there occurs a discharge between the electrodes (time point t5 in FIG. 8B). Thus, by virtue of the action of the diode 5, even after the termination of the capacitive discharge, the sparking voltage $V_1$ is maintained in a high voltage state over a longer time period than at normal firing.

The curves C and C' in FIG. 8B show changes in the comparative level VCOMP with the lapse of time, obtained from the held peak value of the sparking voltage $V_1$. The peak-holding circuit is reset during time points t2 and t3. Therefore, the curves before the time point t2 shows the comparative level VCOMP obtained from the last cylinder which was subjected to ignition. FIG. 8C shows an output from the first comparator 25. As is clear from FIG. 8B and FIG. 8C, at normal combustion, $V_1$>VCOMP holds between the time points t2 and t4, while at misfiring, $V_1$>VCOMP holds between a time point t1 and the time point t5. During each of the durations, the output from the first comparator 25 has a high level. As a result, the output voltage VT from the pulse duration-measuring circuit 26 varies as shown in FIG. 8D, and at misfiring, VT>VTREF stands after a time point t6 as shown in the broken line E' in FIG. 8D. Therefore, the output from the second comparator 28 (misfire-determining output) turns to a high level after the time point t6, to thereby detect occurrence of a misfire as shown in FIG. 8E.

The pulse duration-measuring circuit 26 is reset at a time point t0.

According to the present embodiment, the comparative level VCOMP is set based on the detected sparking voltage, and therefore even if the actually generated sparking voltage or the detected sparking voltage fluctuates, a misfire can be stably detected without being affected by the fluctuation of the sparking voltage. Further, since the diode 5 is provided in the present circuit, the duration over which the sparking voltage $V_1$ exceeds the comparative level VCOMP at misfiring is remarkably longer than that at normal combustion, and therefore accurate detection of occurrence of a misfire is achieved.

Figure 9:
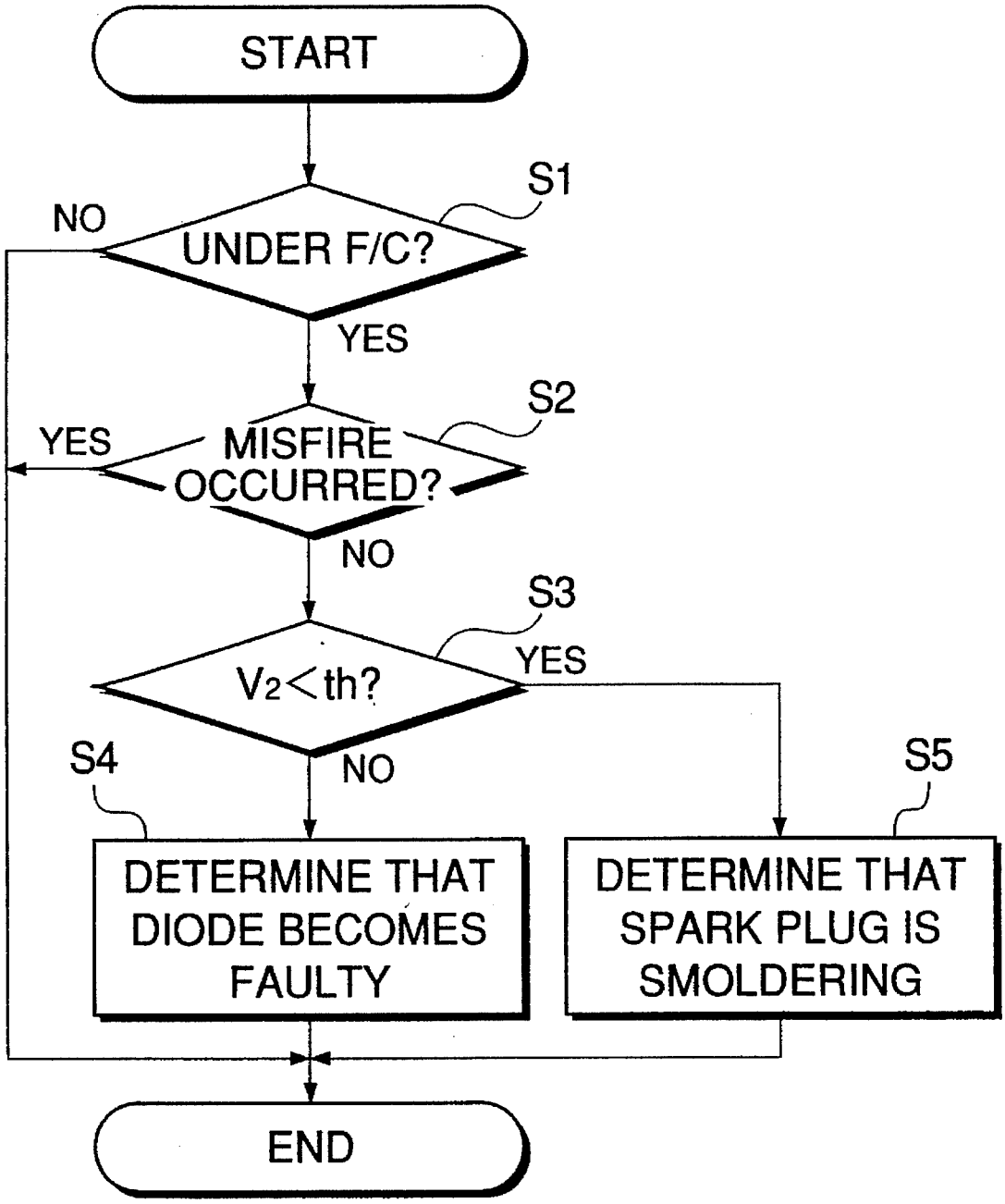
FIG. 9 is a flowchart showing a program for executing abnormality determination.

FIG. 9 shows a program for carrying out the abnormality determination, which is executed by the CPU of the ECU 30.

First, at a step S1, it is determined whether or not the engine is under fuel cut, and if the engine is not under fuel cut, the present program is immediately terminated. If the engine is under fuel cut, it is determined at a step S2 whether or not occurrence of a misfire has been detected at the misfire-determining circuit (FIG. 7), and if occurrence of a misfire has been detected, the present program is immediately terminated. If the engine is not under fuel cut and at the same time a misfire has not been detected, it is determined that some abnormality has occurred, and therefore it is determined at a step S3 whether or not the voltage $V_2$ at the terminal T4 of FIG. 7 is lower than the predetermined voltage Vth. If $V_2<Vth$ stands, it is determined at a step S5 that the spark plug 6 is smoldering, whereas if $V_2 \geqq Vth$ stands, it is determined at a step 4 that the diode 5 is faulty.

Figure 10:
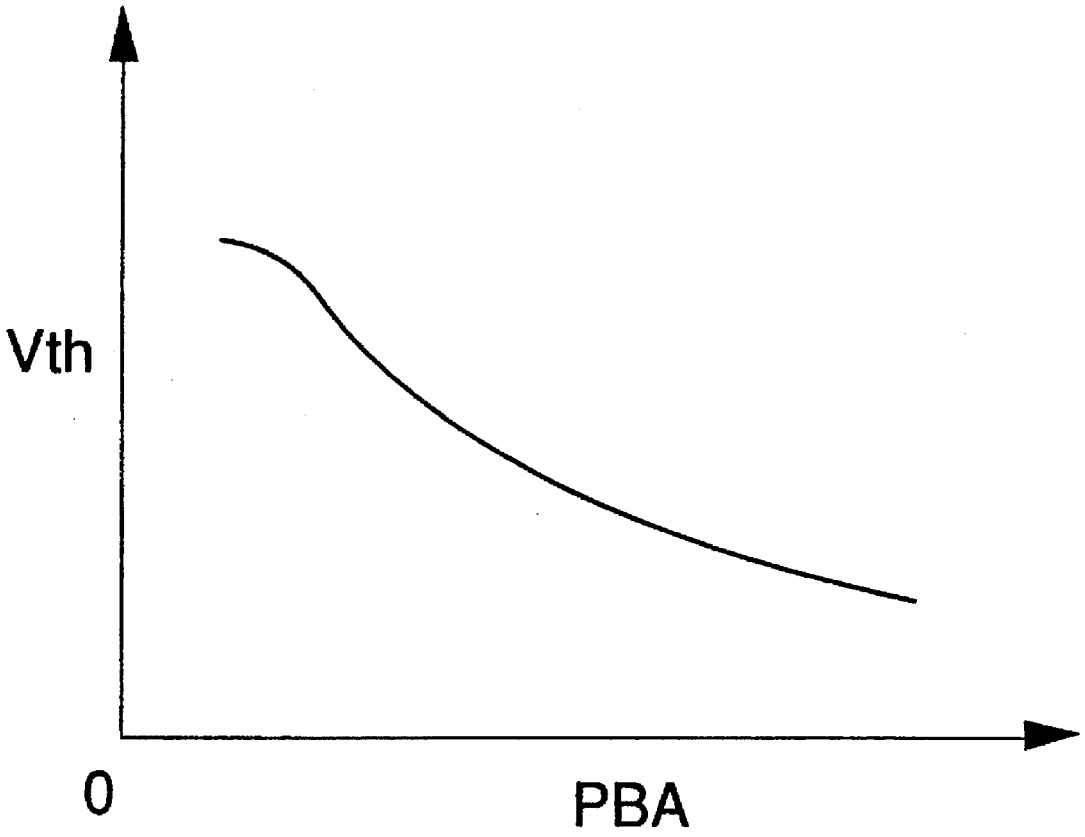
FIG. 10 is a graph showing the relationship between intake pipe absolute pressure PBA and a predetermined voltage level Vth.

The predetermined voltage Vth is set according to the intake pipe absolute pressure PBA of the engine as shown in FIG. 10. The predetermined voltage Vth may be set according to other engine operating parameters, such as the engine rotational speed NE, the engine coolant temperature TW, and the intake air temperature TA.

According to the processing of FIG. 9, since the abnormality determination is executed during fuel cut, the accuracy of the determination can be enhanced. Besides, the abnormality determination is not executed when occurrence of a misfire is detected, and therefore in a case as shown in FIG. 5, it is not erroneously determined that the diode 5 is faulty. In this connection, a misfire has occurred in the case shown in FIG. 4. In the FIG. 4 case, however, since the diode 5 is faulty, it is not determined that a misfire has occurred, i.e. the answer to the question at the step S2 is negative (NO), and therefore failure of the diode 5 can be surely detected and discriminated from smoldering of the spark plug.

What is claimed is:

1. A misfire-detecting system for an internal combustion engine having at least one spark plug, each having opposite ends, and an ignition secondary circuit connected to each of said at least one spark plug, comprising:

reverse current-checking means provided in said ignition secondary circuit, for checking reverse current flowing in said ignition secondary circuit in a direction reverse to a direction of flow of current occurring when spark ignition takes place at said each of said at least one spark plug;

misfire-detecting means for detecting occurrence of a misfire in said engine, based on voltage between said opposite ends of said each of said at least one spark plug assumed when spark discharge takes place at said each of said at least one spark plug;

reverse current-detecting means for detecting said reverse current in said ignition secondary circuit; and abnormality-detecting means for detecting an abnormality of said reverse current-checking means, based on said reverse current detected by said reverse current-detecting means.

2. A misfire-detecting system as claimed in claim 1, wherein said abnormality-detecting means carries out detection of said abnormality of said reverse current-checking means when said engine is in a non-combustion state.

3. A misfire-detecting system as claimed in claim 1 or 2, including abnormality detection-inhibiting means for inhibiting said abnormality-detecting means from carrying out detection of said abnormality of said reverse current-checking means when a misfire occurs in said engine.

4. A misfire-detecting system as claimed in claim 1 or 2, wherein said abnormality-detecting means carries out detection of said abnormality of said reverse current-checking means within a predetermined time period from the time of generation of an ignition command signal.

5. A misfire-detecting system as claimed in claim 1 or 2, wherein said abnormality-detecting means compares a value of said reverse current detected by said reverse current-detecting means with a predetermined value, and determines that said reverse current-checking means is in an abnormal state when said value of said detected reverse current exceeds said predetermined value.

6. A misfire-detecting system as claimed in claim 5, wherein said predetermined value is set based on at least one operating parameter of said engine including a load on said engine.

7. A misfire-detecting system as claimed in claim 5, wherein said abnormality-detecting means determines that said reverse current-checking means is in said abnormal state when said value of said detected reverse current continuously exceeds said predetermined value over a predetermined time period.

* * * * *